US010612349B2

(12) United States Patent
Clemens

(10) Patent No.: US 10,612,349 B2
(45) **Date of Patent: *Apr. 7, 2020**

(54) DOWNHOLE CASING PATCH

(71) Applicant: Halliburton Energy Services, Inc., Houston, TX (US)

(72) Inventor: Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 277 days.

This patent is subject to a terminal disclaimer.

(21) Appl. No.: 15/027,520

(22) PCT Filed: Nov. 6, 2013

(86) PCT No.: PCT/US2013/068774

§ 371 (c)(1),
(2) Date: Apr. 6, 2016

(87) PCT Pub. No.: WO2015/069241

PCT Pub. Date: May 14, 2015

(65) Prior Publication Data

US 2016/0245052 A1 Aug. 25, 2016

(51) Int. Cl.
*E21B 33/13* (2006.01)
*E21B 29/10* (2006.01)
(Continued)

(52) U.S. Cl.
CPC ..... *E21B 43/105* (2013.01); *E21B 29/10* (2013.01); *E21B 43/103* (2013.01); *E21B 43/122* (2013.01)

(58) Field of Classification Search
CPC ..... E21B 33/13; E21B 33/138; E21B 23/01; E21B 29/10; E21B 23/02; F16L 55/165; F16L 55/163
(Continued)

(56) References Cited

U.S. PATENT DOCUMENTS 3,948,321 A * 4/1976 Owen ..... E21B 23/04 166/207
4,830,109 A 5/1989 Wedel
(Continued)

FOREIGN PATENT DOCUMENTS

EP 0418056 B1 11/1995
EP 2581551 A2 4/2013
(Continued)

OTHER PUBLICATIONS

PCT International Search Report and Written Opinion of the International Searching Authority, PCT/US2013/068774, dated Aug. 6, 2014, 11 pages.
(Continued)

*Primary Examiner* — Kenneth L Thompson
(74) *Attorney, Agent, or Firm* — Alan Bryson; Parker Justiss, P.C.

(57) ABSTRACT

A casing patch includes a tubular that comprises a first end and a second end opposite the first end, each of the first end and second end comprising an expandable wedge that is deformable into a wellbore casing; and a locating profile formed onto an inner surface of the tubular between the first and second ends.

2 Claims, 3 Drawing Sheets

(51) Int. Cl.
*E21B 23/02* (2006.01)
*F16L 55/163* (2006.01)
*E21B 43/10* (2006.01)
*E21B 43/12* (2006.01)

(58) Field of Classification Search
USPC ..... 166/277; 138/97, 98
See application file for complete search history.

(56) References Cited

U.S. PATENT DOCUMENTS

| | | | | |
|---|---|---|---|---|
| 5,079,837 | A * | 1/1992 | Vanselow | F28F 11/02 138/97 |
| 5,390,742 | A | 2/1995 | Dines et al. | |
| 5,667,011 | A | 9/1997 | Gill et al. | |
| 6,276,690 | B1 | 8/2001 | Gazewood | |
| 6,446,724 | B2 * | 9/2002 | Baugh | E21B 33/14 166/177.4 |
| 6,622,797 | B2 | 9/2003 | Sivley, IV | |
| 6,742,585 | B1 * | 6/2004 | Braithwaite | E21B 29/10 166/191 |
| 7,048,067 | B1 * | 5/2006 | Cook | E21B 29/10 166/207 |
| 7,172,025 | B2 | 2/2007 | Eckerlin | |
| 7,228,909 | B2 | 6/2007 | Schmidt et al. | |
| 7,779,924 | B2 * | 8/2010 | Clamens | E21B 29/10 166/208 |
| 7,789,138 | B2 | 9/2010 | McGarian et al. | |
| 8,162,067 | B2 * | 4/2012 | Ring | E21B 43/103 166/207 |
| 8,167,312 | B2 | 5/2012 | Adamek | |
| 9,033,041 | B2 * | 5/2015 | Baihly | E21B 23/04 166/297 |
| 9,447,651 | B2 * | 9/2016 | Hallundbæk | E21B 29/10 |
| 9,745,838 | B2 * | 8/2017 | Gorrara | E21B 23/02 |
| 2004/0074640 | A1 | 4/2004 | Anderton et al. | |
| 2006/0237188 | A1 * | 10/2006 | McMahan | E21B 23/01 166/207 |
| 2009/0151929 | A1 * | 6/2009 | Saltel | E21B 29/10 166/177.4 |
| 2012/0211222 | A1 | 8/2012 | Leighton et al. | |
| 2019/0169967 | A1 * | 6/2019 | Clemens | E21B 29/10 |

FOREIGN PATENT DOCUMENTS

| | | | |
|---|---|---|---|
| WO | WO02/35060 | A1 | 5/2002 |
| WO | WO2013/052064 | A1 | 4/2013 |
| WO | WO2014185913 | A1 | 11/2014 |

OTHER PUBLICATIONS

Halliburton—Wireline & Perforating, "Downhole Power Unit (DPU®)—Intelligent Series Tool Real-Time Feedback, so you know without any doubt, the quality of the set", Copyright 2011, 2 pages.

* cited by examiner

300

DOWNHOLE CASING PATCH

CROSS-REFERENCE TO RELATED APPLICATIONS

This application is a U.S. National Phase Application under 35 U.S.C. § 371 and claims the benefit of priority to International Application Serial No. PCT/US2013/068774, filed on Nov. 6, 2013, the contents of which are hereby incorporated by reference.

TECHNICAL BACKGROUND

This disclosure relates to a downhole casing patch.

BACKGROUND

Casings are typically tubular members (e.g., pipes) used in a wellbore for stability purposes and to limit and/or control fluid production from a subterranean zone to a terranean surface. In some cases, the casing may have one or more holes, either purposefully made (e.g., perforations) or due to imperfections or damage to the material of the casing. A casing patch may be used in the remedial repair of casing damage, corrosion, or leaks, or even to cover perforations. Casing patches may be used as short- to medium-term repairs that enable production to be resumed.

DETAILED DESCRIPTION

Figure 1:
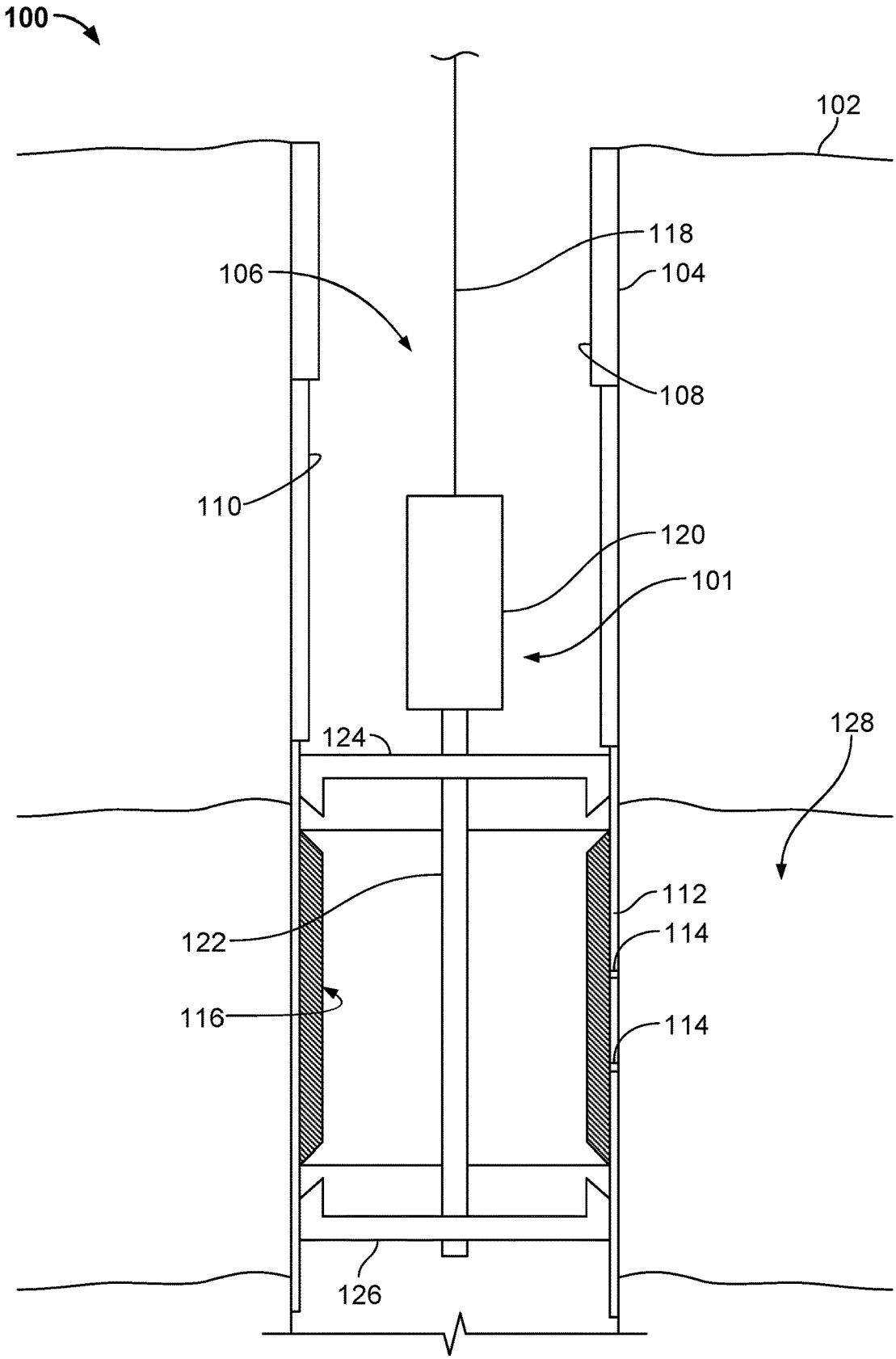
FIG. 1 is a schematic cross-sectional side view of a well system with an example downhole casing patch system.

The present disclosure relates to a downhole casing (or liner) patch that may be expanded by a deployable power unit to create a seal with a downhole tubular (e.g., a production casing, intermediate casing, or other tubular). In some aspects, the casing patch may include a profile formed on an interior radial surface of the patch to, for instance, received and/or constrain a downhole tool (e.g., plug or other flow control tool) in the patch. In some aspects, the downhole casing patch my include a port that facilitates fluid communication and may be used as a gas lift port. In some aspects, the casing patch may be expanded into the downhole tubular at both ends of the patch.

In one general implementation according to the present disclosure, a casing patch includes a tubular that comprises a first end and a second end opposite the first end, each of the first end and second end comprising an expandable wedge that is deformable into a wellbore casing; and a locating profile formed onto an inner surface of the tubular between the first and second ends.

A first aspect combinable with the general implementation further includes a port comprising a fluid passage between a bore of the tubular, that extends between the first and second ends, and an outer surface of the tubular.

In a second aspect combinable with any of the previous aspects, the port is sized based on one or more hydrocarbon well parameters.

In a third aspect combinable with any of the previous aspects, the locating profile is machined into the inner surface of the tubular.

In a fourth aspect combinable with any of the previous aspects, the profile comprises a landing nipple that comprises a no-go shoulder and a seal bore.

In another general implementation, a wellbore casing patch system includes a power unit comprising a connection for a conveyance from a terranean surface through a wellbore, the power unit providing power independent of the conveyance; a piston assembly comprising a rod coupled to the power unit and one or more wedge assemblies coupled to the rod; and a casing patch that comprises a first end and a second end opposite the first end, each of the first and second ends comprising a wedge expandable into a wellbore casing by one of the wedge assemblies.

In a first aspect combinable with the general implementation, the one or more wedge assemblies coupled to the rod comprises a first wedge assembly coupled a distal end of the rod and a second wedge assembly coupled to a proximal end of the rod closest to the power unit, and both of the first and second ends comprise a respective wedge expandable by the first and second wedge assemblies.

In a second aspect combinable with any of the previous aspects, the first wedge assembly is rigidly coupled to the distal end of the rod and moveable toward the second wedge assembly during a stroke of the rod, and the second wedge assembly is slideably coupled to the rod and held stationary during the stroke of the rod into the piston assembly.

In a third aspect combinable with any of the previous aspects, the first and second wedge assemblies deform the respective wedges of the casing patch during the stroke of the rod.

In a fourth aspect combinable with any of the previous aspects, the stroke of the rod comprises a stroke of the rod into the piston assembly.

In a fifth aspect combinable with any of the previous aspects, the power unit comprises a battery that provides electrical power to the piston assembly independently of the conveyance.

A sixth aspect combinable with any of the previous aspects further includes a locating profile formed onto an inner surface of the casing patch between the first and second ends.

A seventh aspect combinable with any of the previous aspects further includes a port comprising a fluid passage between a bore of the casing patch, that extends between the first and second ends, and an outer surface of the casing patch.

In an eighth aspect combinable with any of the previous aspects, the port is sized based on one or more hydrocarbon well parameters.

In a ninth aspect combinable with any of the previous aspects, the locating profile is machined into the inner surface of the casing patch.

In another general implementation, a method includes positioning a tubular component and a deployable power unit near a portion of a wellbore casing in a wellbore; aligning a downhole wedge assembly mounted on a piston of the deployable power unit with a downhole ramped end of the tubular component; aligning an uphole wedge assembly mounted on the piston with an uphole ramped end of the tubular component; and expanding the uphole ramped end and the downhole ramped end of the tubular component into the portion of the wellbore casing by urging one of the downhole wedge assembly or the uphole wedge assembly towards the other of the downhole wedge assembly or the uphole wedge assembly.

A first aspect combinable with the general implementation further includes removing at least a portion of the deployable power unit, the downhole wedge assembly, and the uphole wedge assembly from the wellbore to a terranean surface; running a downhole tool into the wellbore; and positioning an outer surface of the downhole tool into a profile formed on an inner surface of the tubular component.

A second aspect combinable with any of the previous aspects further includes flowing a fluid through a port in the tubular component from a subterranean zone to a bore of the tubular component and to the terranean surface.

In a third aspect combinable with any of the previous aspects, the tubular component comprises a casing patch.

In a fourth aspect combinable with any of the previous aspects, expanding the tubular component into the portion of the wellbore casing by urging one of the downhole wedge assembly or the uphole wedge assembly towards the other of the downhole wedge assembly or the uphole wedge assembly comprises stroking the piston into the deployable power unit to urge the downhole wedge assembly against the downhole ramped end of the tubular component and towards the uphole wedge assembly; holding the uphole wedge assembly against the uphole end of the tubular component during the stroke of the piston into the deployable power unit; and expanding the uphole and downhole ramped ends into the portion of the wellbore basing based on the stroke of the piston into the deployable power unit.

A fifth aspect combinable with any of the previous aspects further includes hydraulically sealing between the tubular component and the portion of the wellbore casing based on expanding the tubular component into the portion of the wellbore casing.

In a sixth aspect combinable with any of the previous aspects, creating a hydraulic seal between the tubular component and the portion of the wellbore casing comprises deforming a portion of the downhole ramped end and a portion of the uphole ramped end into the portion of the wellbore casing to create a metal-to-metal seal.

Various implementations of a downhole casing patch system in accordance with the present disclosure may include one, some, or all of the following features. For example, the casing patch system may set a casing patch in a wellbore without power being supplied from a terranean surface. As another example, the casing patch may include a profile into which another downhole tool may be set. As another example, the downhole patch may provide a metered orifice for gas lift.

FIG. 1 is a schematic cross-sectional side view of a well system 100 with an example downhole casing patch system 101. The well system 100 is provided for convenience of reference only, and it should be appreciated that the concepts herein are applicable to a number of different configurations of well systems. The well system 100 includes a wellbore 104 that extends from a terranean surface 102 through one or more subterranean zones of interest 128. In FIG. 1, the wellbore 104 extends vertically from the surface 102 to and/or through the subterranean zone 128. In other instances, the wellbore 104 can be of another position, for example, deviates to horizontal in the subterranean zone 128, entirely substantially vertical or slanted, it can deviate in another manner than horizontal, it can be a multi-lateral, and/or it can be of another position.

Moreover, although shown on a terranean surface, the system 100 may be located in a sub-sea or water-based environment. For example, in some implementations, a drilling assembly used to create the wellbore 104 may be deployed on a body of water rather than the terranean surface 102. For instance, in some implementations, the terranean surface 102 may be an ocean, gulf, sea, or any other body of water under which hydrocarbon-bearing formations may be found. In short, reference to the terranean surface 102 includes both land and water surfaces and contemplates forming and/or developing one or more deviated wellbore systems 100 from either or both locations At least a portion of the illustrated wellbore 104, which forms a borehole 106, may be lined with a casing. As illustrated, the wellbore 104 includes a conductor casing 108, which extends from the terranean surface 102 shortly into the Earth. Downhole of the conductor casing 108 may be the surface casing 110. The surface casing 110 may enclose a slightly smaller wellbore and protect the borehole 106 from intrusion of, for example, freshwater aquifers located near the terranean surface 102. A portion of the wellbore 104 downhole of the surface casing 110 may be enclosed by an intermediate or production casing 112.

As illustrated, the production casing 112 may include one or more apertures 114 that allow fluid communication of hydrocarbons (e.g., oil, gas, a multiphase hydrocarbon fluid) from the subterranean zone 128 into the borehole 106. In some aspects, the apertures 114 may be perforations purposefully created (e.g., by explosives, lasers, jetting tools or otherwise) in the production casing 112 so as to allow production of such hydrocarbon fluids to the surface 102. In some aspects, the apertures 114 may be damaged portions of the production casing 112, e.g., holes in the production casing 112 accidentally formed by downhole tools (e.g., a punch tool) or defective portions of the production casing 112.

System 100 includes the downhole casing patch system 101. As illustrated, the system 101 includes a power unit 120 that is positioned in the wellbore 104 by a downhole conveyance 118 that extends back to the terranean surface. The system 101 also includes a piston assembly coupled to the power unit 120 that includes a rod 122, a downhole wedge assembly 126, and an uphole wedge assembly 124. The system 101 also includes a casing patch 116 formed as a tubular section that fits into the wellbore 104 adjacent the production casing 112.

As illustrated, system 101 is coupled to (e.g., supported by) the downhole conveyance 118, which can be, for example, a wireline, a slickline, an electric line or other conveyance such as coiled tubing. In the illustrated embodiment, the downhole conveyance 118 can support a downhole tool string (e.g., one or more downhole tools). In this example, the conveyance 118 includes a braided (e.g., multiple bound, or intertwined, wires such as wireline or electric line) or solid wire (e.g., a single wire such as slickline). In some aspects, electrical power may be supplied to the power unit 120 by the conveyance 118; in alternative aspects, no electrical power (or other power) is supplied to the power unit 120 from the conveyance 118. In some aspects, the downhole conveyance 118 may include a communication line. The communication line may be coupled with the braided or solid wire such as, for example, embedded in, intertwined with one or more wires, or wrapped around or within one or more wires, in a non-linear (e.g., undulating, helical, zig-zag, or otherwise) configuration.

In one example implementation, the downhole conveyance 118 is a slickline that includes a solid wire and a communication line. The slickline supports the system 101 and can communicate instructions, data, and/or logic between the system 101 and the terranean surface 102 though a communication line (e.g., optical fiber, metallic conductor, or non-metallic conductor).

In some implementations, the downhole casing patch system 101 may communicate with computing systems or other equipment at the surface 102 using the communication capabilities of the downhole conveyance 118. For example, the downhole casing patch system 101 may send and receive electrical signals and/or optical signals (e.g., data and/or logic) through respective conductor wire and/or fiber optics of the communication line within the downhole conveyance 118. In addition, the downhole casing patch system 101 may be lowered or raised relative to the wellbore 104 by respectively extending or retrieving the downhole conveyance 118.

The illustrated power unit 120, in some aspects, may be or include a downhole power unit (DPU) that is battery powered and may operate (e.g., the piston assembly including the rod 122) independently of any power being supplied (or not supplied) by the downhole conveyance 118. For instance, one example implementation of the power unit 120 may be a non-explosive, electro-mechanical setting tool that generates a precisely controlled linear force with real-time feedback delivered to, for instance, the rod 122 in the piston assembly (e.g., Halliburton's Downhole Power Unit (DPU®) Intelligent series tool). For instance, the piston assembly and, more specifically, the rod 122, may be attached to the power unit 120, and a stroke length, setting force, and the rate at which the force is applied during the setting operation (e.g., stroke in or stroke out of the rod 122 relative to the power unit 120), are determined (e.g., based on force necessary to expand the casing patch 116 into the production casing 112). The power unit 120 may deliver a controlled setting motion and then may be retrieved from the wellbore 104.

The piston assembly, which in some aspects, may be part of the power unit 120, also includes uphole and downhole wedge assemblies 124 and 126, respectively, coupled to the rod 122 as illustrated in FIG. 1. As explained more fully with reference to FIG. 2, upon operation of the power unit 120, the wedge assemblies 124 and 126 may interface with respective axial edges or surfaces of the casing patch 116 so as to expand or deform the patch 116 into the production casing 112. Once expanded, the casing patch 116 may create a hydraulic seal (e.g., metal-to-metal) with the production casing 112 (or other tubular, such as another type of casing or a wellbore liner) in order to, for instance, close fluid communication through the apertures 114, prevent (e.g., substantially or otherwise) fluid communication between the casing patch 116 and the production casing 112, or even prevent (e.g., substantially or otherwise) fluid communication between the subterranean zone 128 and the borehole 106.

Figure 2:
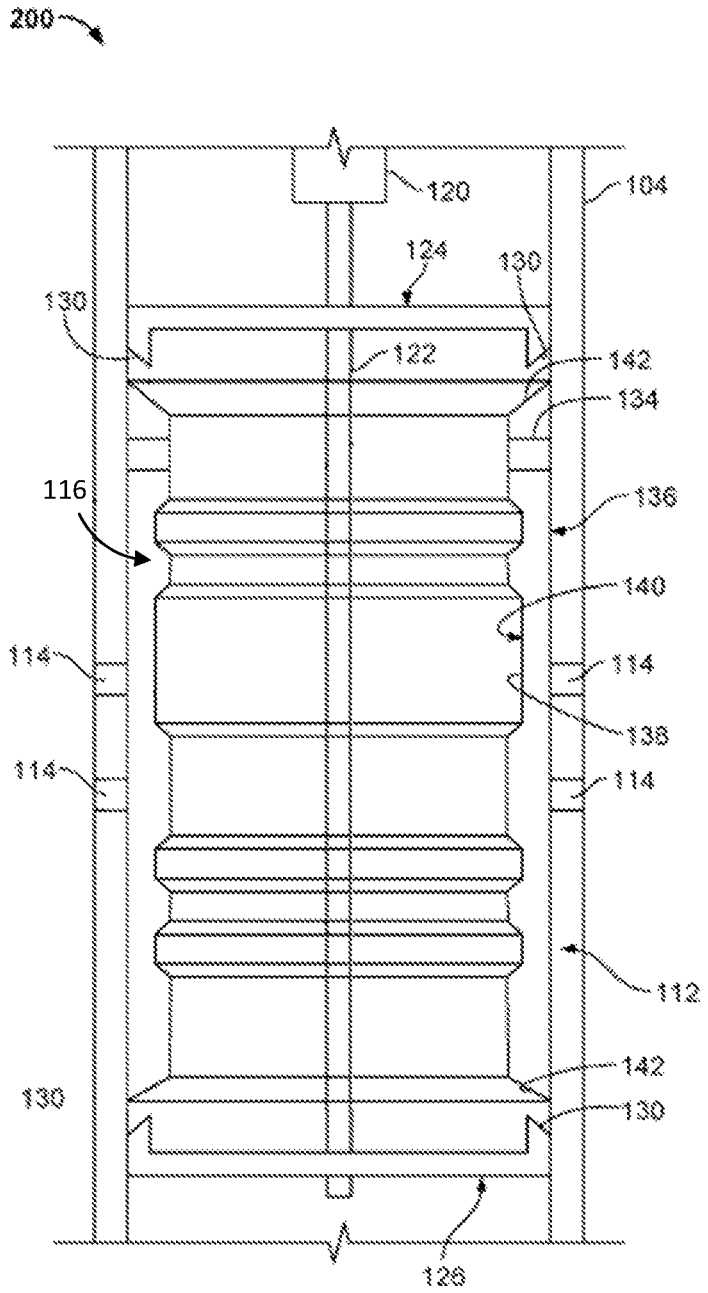
FIG. 2 illustrates a cross-sectional view of an example downhole casing patch system.

FIG. 2 illustrates a cross-sectional view of an example downhole casing patch system 200. As illustrated, the system 200 includes the casing patch 116 that is positioned in the wellbore 104 at or near a portion of the casing 112 which includes one or more apertures 114. As illustrated, the DPU 120 is positioned in the wellbore 104 and is coupled to (or includes) the piston 122. The downhole wedge assembly 126 is coupled to the piston 122 at a downhole end of the piston 122 and the uphole wedge assembly 124 is coupled to the piston 122 at an uphole end.

As illustrated, the casing patch 116 includes an outer radial surface 136 adjacent the casing 112 and an inner radial surface 140 that includes a profile 138. Generally, the profile 138 provides for a landing spot or lock for a downhole tool, such as a plug or other flow control device. In some aspects, the profile 138 may include a landing nipple that has a no-go shoulder or other lock. In some aspects, the profile 138, as a landing nipple, may also include a seal bore area. As further illustrated, the casing patch or tubular 116 includes a gas lift port 134.

As shown in FIG. 2, the illustrated implementation of the wedge assemblies 124 and 126 include ramped edges 130 that angularly interface with ramped ends 142 of the tubular 116. In one example operation of the system 200, once the tubular 116 is positioned at a particular depth in the wellbore 104 (e.g., to cover the apertures 114), the DPU 120 operates the rod 122 (e.g., strokes the rod 122 into the DPU 120) to urge the downhole wedge assembly 126 upward toward the uphole wedge assembly 124. The ramps 130 of the wedge assembly 126 interface with the ramps 142 at the downhole end of the tubular 116, thereby urging the tubular 116 slightly uphole to contact the uphole wedge assembly 124 (e.g., the ramps 142 of the uphole end of the tubular 116 contactingly interface the ramps 130 of the wedge assembly 124). As the downhole wedge assembly 126 is further urged uphole by a setting force of the piston 122, the ramps 130 of the wedge assemblies engage the ramps 142 of the tubular 116 and expand the ends of the tubular 116 into the casing 112. In some aspects, the ends of the tubular 116 are plastically deformed into the casing 112 to create a hydraulic, metal-to-metal seal between the tubular 116 and the casing 112.

Figure 3:
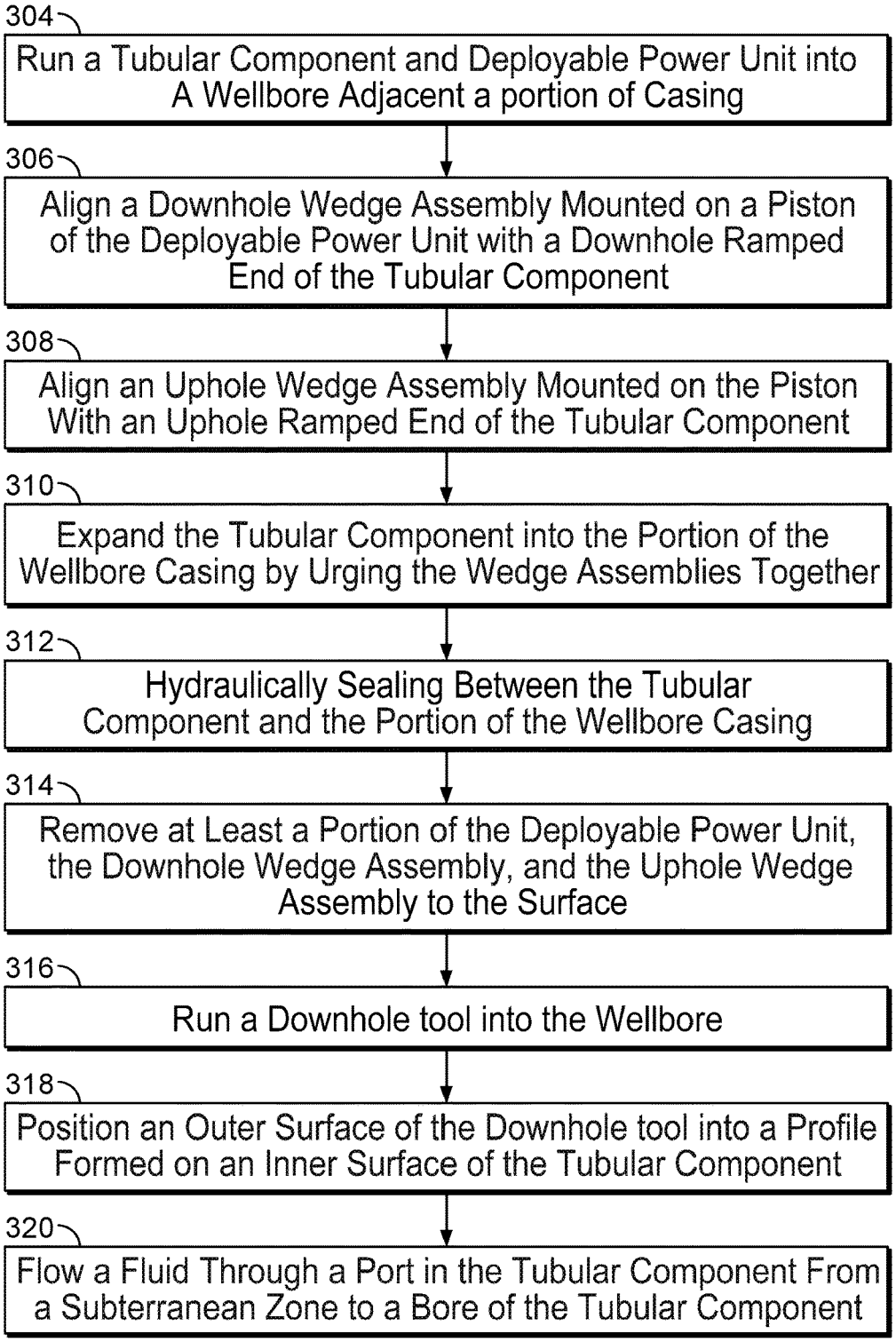
FIG. 3 illustrates an example method for using a downhole casing patch.

FIG. 3 illustrates an example method 300 for using a downhole casing patch. In some aspects, method 300 may be performed with the example downhole casing patch system 101 as shown in FIG. 1, or the downhole casing patch system 200 as shown in FIG. 2, or another casing patch system according to the present disclosure. Method 300 may begin at step 304, when a tubular component (e.g., a casing patch) is run into a wellbore with a deployable power unit until the tubular component is adjacent a portion of a wellbore casing (e.g., a production casing or other type of casing). The tubular component and DPU may be run in on a downhole conveyance (e.g., a wireline, slickline, e-line or other conveyance). In some aspects, the portion of the wellbore casing may include apertures (e.g., perforations or other holes or defects in the casing). In some aspects, the casing patch is run into the wellbore so as to create a hydraulic seal across such apertures in order to, for instance, prevent (e.g., substantially or otherwise) fluid from flowing through the apertures.

At step 306, a downhole wedge assembly mounted on a piston (e.g., rod) of the DPU is aligned with a downhole end of the tubular component. For example, the downhole end of the tubular component may include a ramped edge that interfaces with the wedge assembly. At step 308, an uphole wedge assembly mounted on the piston is aligned with an uphole end of the tubular component. For example, the uphole end of the tubular component may also include a ramped edge that interfaces with the uphole wedge assembly. In some aspects, the downhole wedge assembly is rigidly (e.g., threadingly or otherwise) mounted to a downhole end of the piston while the uphole wedge assembly is slidingly mounted on the piston. Thus, during movement of the piston (e.g., stroking into the DPU), the downhole wedge assembly may move with movement of the piston while the uphole wedge assembly may remain stationary (e.g., exactly or substantially).

At step 310, the tubular component is expanded (e.g., plastically deformed) into the casing by urging the wedge assemblies together. In some aspects, the wedge assemblies are urged together by movement (e.g., stroke) of the piston into the DPU, which moves the downhole wedge assembly upward to contact the downhole end of the tubular component. The tubular component is then moved into contact with the uphole wedge assembly, which is held relatively stationary. As the piston further moves to urge the wedge assemblies together, the tubular component may be expanded into the wellbore casing.

At step 312, the tubular component and wellbore casing is hydraulically sealed based on expansion of at least the uphole and downhole ends of the tubular component into the casing. In some aspects, such expansion may result in a metal-to-metal seal between the tubular component and the casing. One or more apertures through the wellbore casing may thus be sealed against fluid flow therethrough.

At step 314, all or portions of the DPU, including the wedge assemblies and/or piston, may be removed from the wellbore to the terranean surface. In some aspects, removal of such components may allow for full wellbore communication (e.g., of fluids, downhole tools, or otherwise) through the tubular component.

At step 316, a downhole tool, such as a plug or other tool, may be run into the wellbore to the depth of the tubular component that is expanded into the wellbore casing. In step 318, the downhole tool is positioned in the wellbore so that an outer surface of the tool is set into a profile formed on an inner surface of the tubular component. In some aspects, the profile on the tubular component may be a landing nipple machined into the inner surface, or another profile.

At step 320, fluid (e.g., gas or other fluid) is communicated from, for example, a subterranean zone to a bore of the tubular component through a port in the tubular component. The port may include a metered orifice with a set or variable diameter and may extend between the outer and inner surfaces of the tubular component. In some aspects, the port may be a gas lift orifice that permits gas to pass through and is sized based on well parameters. The flow of gas through the port may be used to enhance lift and production of well fluids to the surface.

A number of examples have been described. Nevertheless, it will be understood that various modifications may be made. For example, one or more operations described herein (e.g., method 300 described in FIG. 3) may be performed with additional steps, fewer steps, in varying orders of operation, and/or with some steps performed simultaneously. Accordingly, other examples are within the scope of the following claims.

What is claimed is:

1. A casing patch, comprising:

a metal tubular that comprises a first end and a second end opposite the first end, each of the first end and second end comprising an expandable wedge that is deformable into a wellbore casing;

a locating profile machined into an inner surface of the tubular between the first and second ends, wherein the locating profile comprises a landing nipple that comprises a no-go shoulder and a seal bore; and a port comprising a fluid passage extending between a bore of the tubular and an outer surface of the tubular, the port located between the first and second ends.

2. The casing patch of claim 1, wherein the port is sized based on one or more hydrocarbon well parameters.

* * * * *